US010096929B2

(12) United States Patent
Lee et al.

(10) Patent No.: US 10,096,929 B2
(45) Date of Patent: Oct. 9, 2018

(54) SAFETY SOCKET DEVICE

(71) Applicant: POWERTECH INDUSTRIAL CO., LTD., New Taipei (TW)

(72) Inventors: Yu-Lung Lee, New Taipei (TW); Tun-Chi Yu, Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/168,361

(22) Filed: May 31, 2016

(65) Prior Publication Data

US 2017/0279214 A1 Sep. 28, 2017

(30) Foreign Application Priority Data

Mar. 25, 2016 (TW) ..... 105109452 A

(51) Int. Cl.
*H01R 13/44* (2006.01)
*H01R 13/453* (2006.01)

(52) U.S. Cl.
CPC ..... *H01R 13/4538* (2013.01)

(58) Field of Classification Search
CPC ..... H01R 13/4534; H01R 13/4532; H01R 13/4538; H01R 13/447
USPC ..... 439/137, 139, 140, 143, 145
See application file for complete search history.

(56) References Cited

U.S. PATENT DOCUMENTS 4,867,694 A * 9/1989 Short ..... H01R 13/4534 439/137
6,893,275 B2 * 5/2005 Ng ..... H01R 13/4534 439/137
7,556,513 B2 * 7/2009 Ng ..... H01R 13/4534 439/137
7,833,030 B1 * 11/2010 Huang ..... H01R 13/4534 439/137
7,883,346 B2 * 2/2011 Huang ..... H01R 13/4534 439/140
8,187,012 B1 * 5/2012 Baldwin ..... H01R 13/4534 439/137
8,382,497 B2 * 2/2013 Huang ..... H01R 13/4534 439/137
8,632,347 B2 * 1/2014 Chen ..... H01R 13/453 439/137
9,196,995 B2 * 11/2015 Scanzillo ..... H01R 13/453

* cited by examiner

*Primary Examiner* — Thanh Tam Le
(74) *Attorney, Agent, or Firm* — Li & Cai Intellectual Property (USA) Office

(57) ABSTRACT

A safety socket device includes a carrier, a first movable assembly and a second movable assembly. The carrier has a first plug hole and a second plug hole. The first movable assembly including a first moving element is transversely movably disposed in the carrier. The first moving element has two first guide portions, and the two first guide portions are moved for exposing the first plug hole from the first moving element by an external pushing force. The second movable assembly including a second moving element is longitudinally movably disposed in the carrier. The second moving element has a second guide portion, and the second guide portion is moved for exposing the second plug hole from the second moving element by the external pushing force.

13 Claims, 14 Drawing Sheets

Z

SAFETY SOCKET DEVICE

BACKGROUND OF THE INVENTION

1. Field of the Invention

The instant disclosure relates to a safety socket device; in particular, a safety socket device to provide safety and a dustproof effect.

2. Description of Related Art

Sockets continually supply power and there will be a danger of electric-shock.

In view of this requirement, the instant invention provides a safety socket device for improving electrical safety by preventing foreign bodies from inserting into the socket.

SUMMARY OF THE INVENTION

The instant invention provides a safety socket device to prevent a foreign body from inserting into a socket and for dustproofing by movement of a first movable assembly and a second movable assembly.

An exemplary embodiment of the present disclosure provides a safety socket device comprising: a carrier, a first movable assembly and a second movable assembly. The carrier has a first plug hole and a second plug hole. The first movable assembly includes a first moving element transversely movably disposed in the carrier. The first moving element has two first guide portions, and the two first guide portions can be moved exposing the first plug hole from the first moving element by an external pushing force. The second movable assembly includes a second moving element longitudinally movably disposed in the carrier. The second moving element has a second guide portion, and the second guide portion can be moved exposing the second plug hole from the second moving element by an external pushing force.

Therefore, the advantages of the instant disclosure are providing a safety socket device, when a foreign body inserts into the socket, the first plug hole and the second plug hole are still shielded by the first movable assembly and the second movable assembly, thus there can effectively prevent the inserting foreign body. This design of the instant disclosure improves the safety of the socket by avoiding the danger of electric-shock.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

DETAILED DESCRIPTION OF THE PREFERRED EMBODIMENTS

Figure 1:
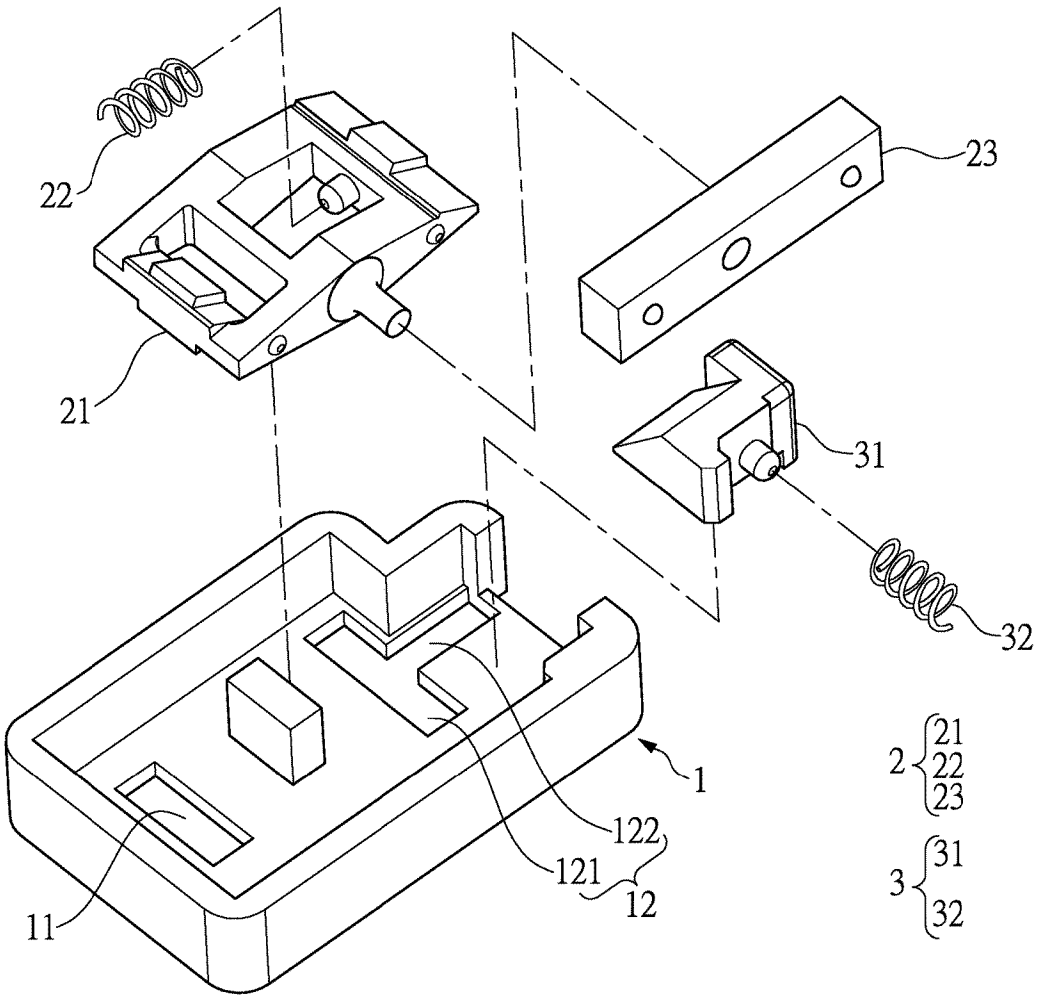
FIG. 1 shows a perspective exploded view of the safety socket device according to the instant disclosure.

FIG. 1 shows a perspective exploded view of the safety socket device according to the instant disclosure. The embodiment provides a safety socket device Z comprising: a carrier 1, a first movable assembly 2 and a second movable assembly 3. The carrier 1 has a first plug hole 11 and a second plug hole 12, and the first movable assembly 2 and the second movable assembly 3 are movably disposed in the carrier 1.

The first movable assembly 2 includes a first moving element 21, a first elastic element 22 and a connecting element 23. The second movable assembly 3 includes a second moving element 31 and a second elastic element 32. Furthermore, the first movable assembly 2 is transversely movably disposed in the carrier 1, and the second movable assembly 3 is longitudinally movably disposed in the carrier 1, such that a movement direction of the first movable assembly 2 is perpendicular to a movement direction of the second movable assembly 3.

The first plug hole 11 is perpendicular to a portion of the second plug hole 12 of the carrier 1 thereon. Specifically, the second plug hole 12 has a first portion 121 parallel to the first plug hole 11 and a second portion 122 communicated with the first portion 121 and perpendicular to the first plug hole 11. Hence, the first portion 121 and the second portion 122 of the second plug hole 12 form a T-shape. Based on the first portion 121 and the second portion 122 of the second plug hole 12 and the distance between the first plug hole 11 and the second plug hole 12, the embodiment of a safety socket device Z according to the instant invention not only provides for two flat blades of a parallel plug to insert into the socket, but also provides for two perpendicular blades of a perpendicular slot plug to insert into the socket.

Figure 2:
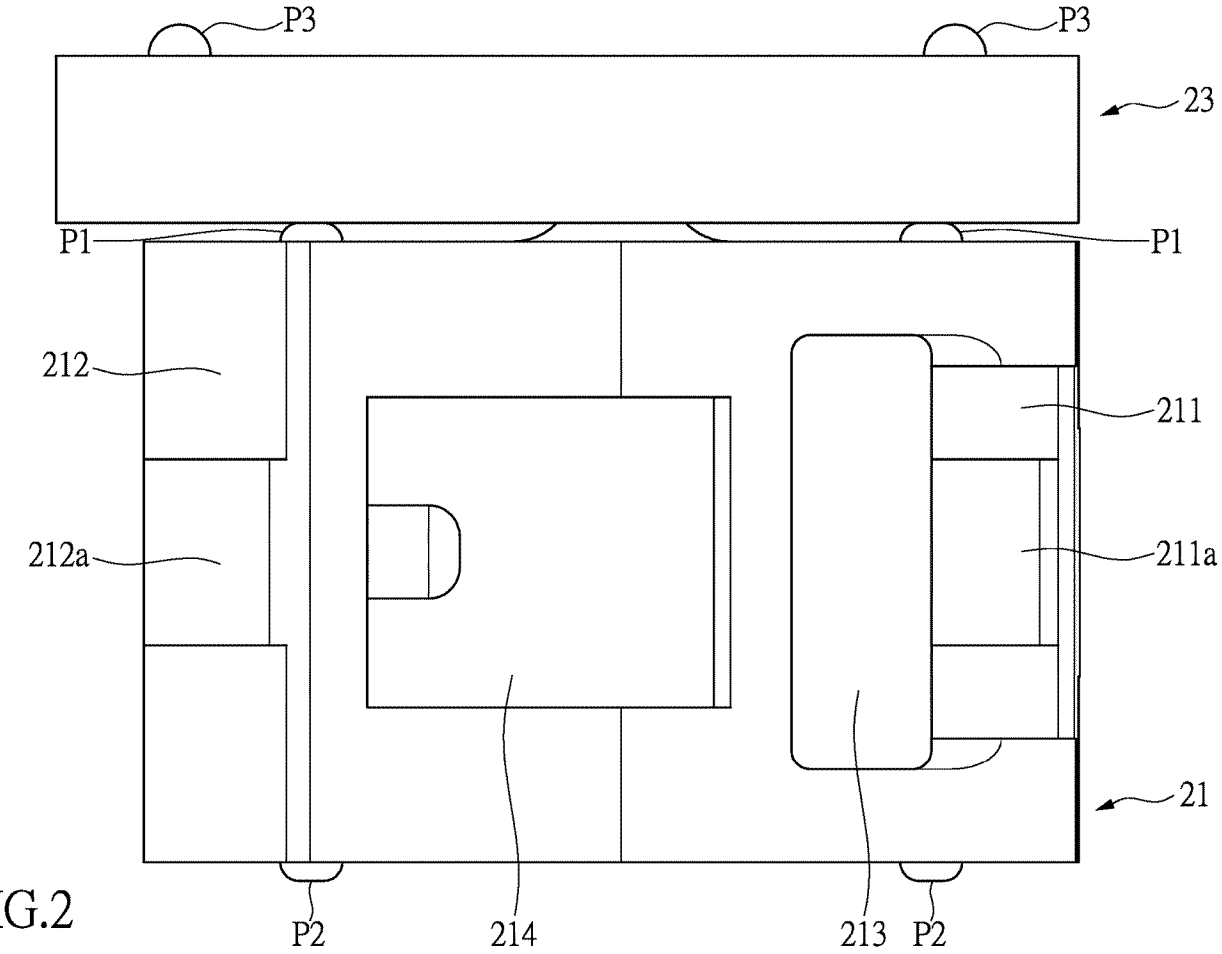
FIG. 2 shows a top perspective assembly schematic view of the first moving element and a connecting element according to the instant disclosure.

Please refer to FIG. 1 and FIG. 2. FIG. 2 shows a top perspective assembly view of the first moving element and a connecting element according to the instant disclosure. The first movable assembly 2 includes a first moving element 21, a first elastic element 22 and a connecting element 23. The first moving element 21 is transversely movably disposed in the carrier 1, and the first moving element 21 has two first guide portions 211, 212. The two first guide portions 211, 212 are moved exposing the first plug hole 11 from the first moving element 21 by an external pushing force.

Subsequent to the above, the first moving element 21 is a three dimensional rhombic-like structure, where the thickness of a central fulcrum portion of the first moving element 21 is greater than two end portions of the first moving element 21 for providing a cushion space for the blades of a plug to insert into the socket. The first moving element 21 further includes an opening 213 corresponding to the first plug hole 11 and a restriction opening 214 is disposed adjacent to the opening 213. The two of first guide portions 211, 212 are respectively disposed on two end portions of the first moving element 21. One of the two of first guide portions 211 is disposed adjacent to a side of the opening 213, and other of the two of first guide portions 212 is disposed adjacent to a side of the restriction opening 214. Two of first guide portions 211, 212 of the first moving element 21 are guiding inclined surfaces for assisting the blades of a plug to insert into the socket. In addition, the first guide portions 211 further include a first guide protrusion 211*a* protruded on the guiding inclined surface, and the first of guide portion 212 further include a first guide protrusion 212*a* protruded on the guiding inclined surface. When the blades of a plug insert into the safety socket device Z, the blades respectively contact to two of first guide protrusions 211*a*, 212*a* firstly for assisting insertion to the safety socket device Z.

Figure 3:
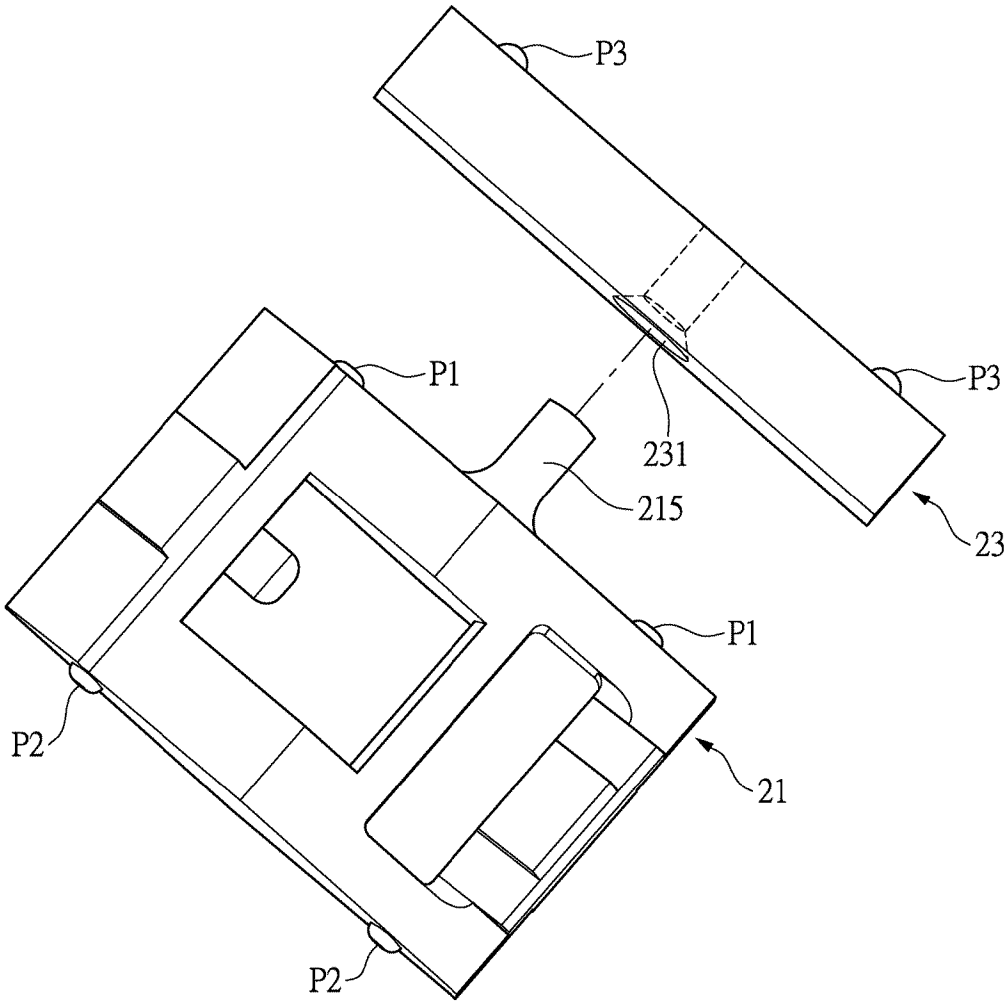
FIG. 3 shows a top perspective exploded schematic view of the first moving element and the connecting element according to the instant disclosure.

Please refer to FIG. 1 and FIG. 3. FIG. 3 shows a top perspective exploded view of the first moving element and the connecting element according to the instant disclosure. In this embodiment, the first movable assembly 2 further includes the connecting element 23 which connects with the first moving element 21. The connecting element 23 has a connecting hole 231 thereon, wherein the connecting hole 231 is mated with a connecting column 215 disposed on the first moving element 21, and the first moving element 21 is moved to move the connecting element 23. In another embodiment, the first moving element 21 is integrally formed with the connecting element 23 of the first movable assembly 2, thereby the first moving element 21 and the connecting element 23 are without any additional connection means. Alternatively, the first moving element 21 can connect with the connecting element 23 by a different structure. The connection means could be adjusted by those of ordinary skill in the art, and it is not limited herein.

Please refer to FIG. 2. In this embodiment, a length of the connecting element 23 is greater than a length of the first moving element 21. The connecting element 23 could abut against the second movable assembly 3 to prevent movement of the second moving element 31 while a foreign body is inserted into the safety socket device. The movement of the first moving element 21 and the connecting element 23 will be described in detail below. In addition, a lateral side of the first moving element 21 and a lateral side of the connecting element 23 respectively includes at least one projecting portion, in this embodiment for example P1, P2, P3. Projecting portions P1 are used to reduce the friction force between the first moving element 21 and the connecting element 23 and protect the elements from damage. Projecting portions P2 are used to reduce the friction force between the first moving element 21 and the carrier for increasing movement fluency of the first moving element 21. Projecting portions P3 are used to reduce the friction force between the connecting element 23 and the carrier for increasing movement fluency of the connecting element 23.

Figure 4:
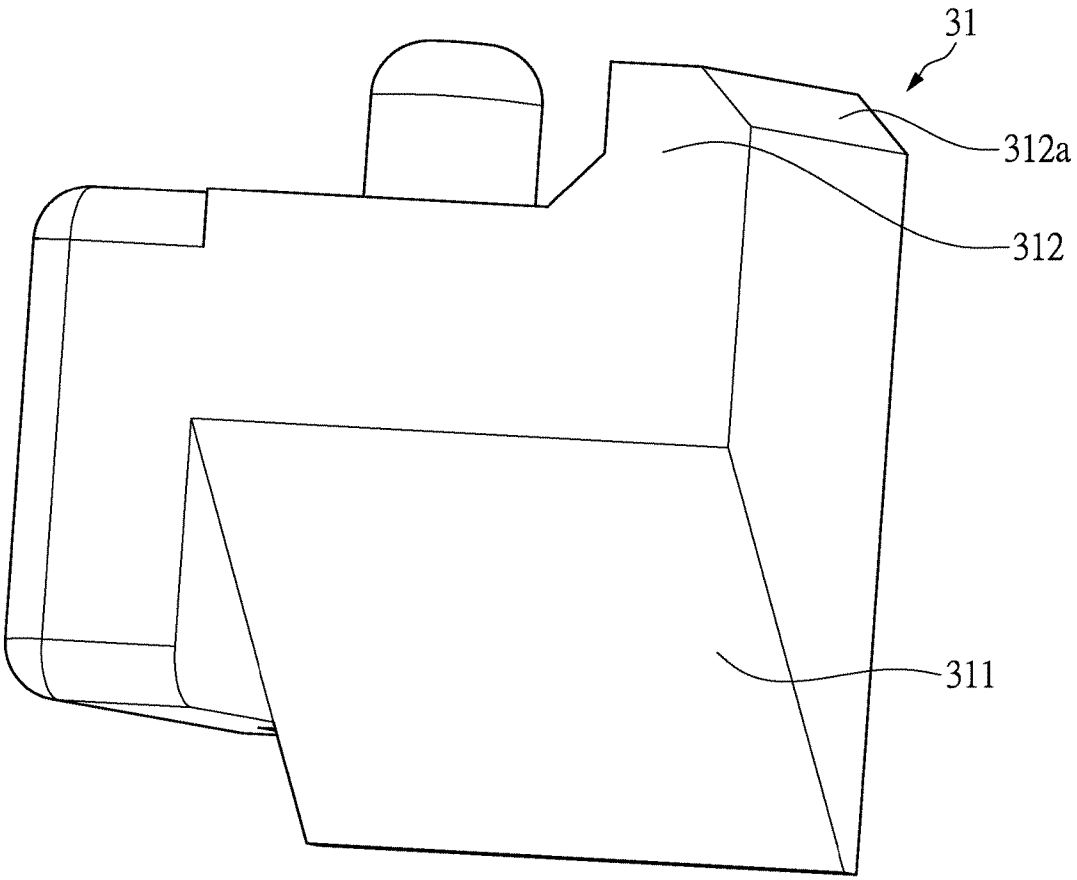
FIG. 4 shows a top perspective schematic view of the second moving element according to the instant disclosure.

Please refer to FIG. 1 and FIG. 4. FIG. 4 shows a top perspective view of the second moving element according to the instant disclosure. The second movable assembly 3 includes a second elastic element 32 and a second moving element 31 longitudinally movably disposed in the carrier 1, wherein the second moving element 31 has a second guide portion 311, and the second guide portion 311 is moved to expose the second plug hole 12 by an external pushing force. The second guide portion 311 of the second moving element 31 is a guiding inclined surface for assisting blades of a plug to insert into the safety socket device Z.

Subsequent to the above, the second moving element 31 further includes a stopping portion 312 having a curved chamfer, and the stopping portion 312 is abutted against the connecting element 23 for limiting movement of the second moving element 31. In addition, the chamfer 312*a* is disposed on the stopping portion 312 for reducing the friction force by the first movable assembly 2 moving away from the second moving element 31.

Figure 5:
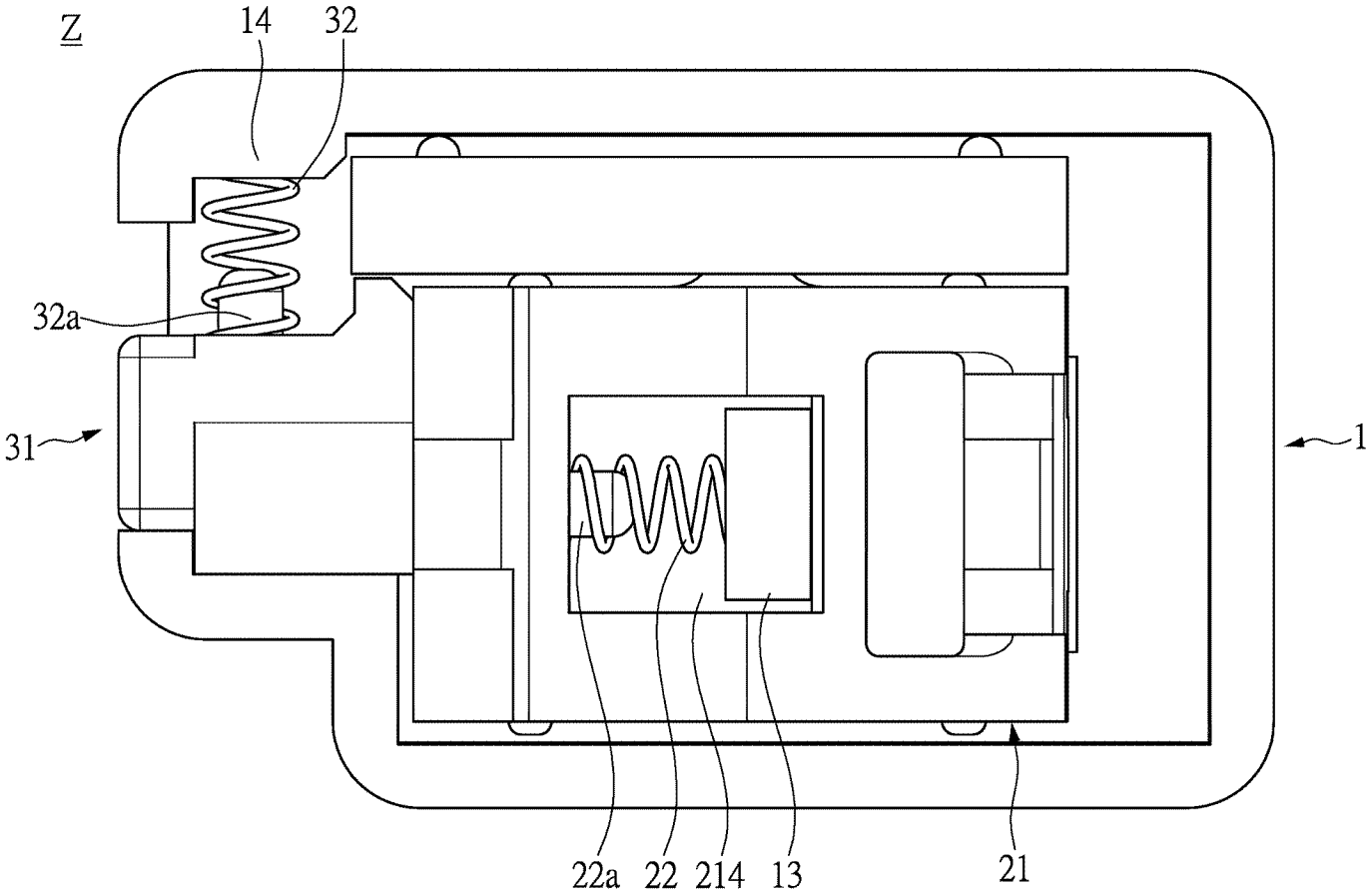
FIG. 5 shows a top perspective schematic view of the safety socket device according to the instant disclosure.

The movement of the second movable assembly 3 in relation to the first movable assembly 2 will be described in detail as below. FIG. 5 shows a top perspective view of the safety socket device according to the instant disclosure. Specifically, FIG. 5 shows the top perspective view of the safety socket device Z in a non-usage state (normal state).

A movement direction of the first movable assembly 2 is perpendicular to a movement direction of the second movable assembly 3. Especially, a movement direction of the first moving element 21 is perpendicular to a movement direction of the second moving element 31. Furthermore, the first elastic element 22 of the first movable assembly is connected between the first moving element 21 and the carrier 1. The second elastic element 32 of the second movable assembly 3 is connected between the second moving element 31 and the carrier 1. In addition, the first elastic element 22 and the second elastic element 32 can be a spring, or any element having elastic structure, and it is not limited herein. The first elastic element 22 is disposed perpendicularly to the second elastic element 23.

Please refer to FIG. 5. A first convex column 22*a* is protruded from an inner wall of the restriction opening 214 of the first moving element 21, and one end portion of the first elastic element 22 is disposed around (such as sleeved on) the first convex column 22*a* and another end portion of the first elastic element 22 abutted against a fixed column 13 of the carrier 1. The fixed column 13 has a groove for accommodating the first elastic element 22 (not shown) so that the first elastic element 22 is limited in the groove when the first elastic element 22 is deformed by the external pushing force. The second elastic element 23 has a second convex column 32*a*, and one end portion of the second elastic element 32 is disposed around (such as sleeved on) the second convex column 32*a* and another end portion of the second elastic element 32 is disposed on an accommodation portion 14 of the carrier 1. Similarly, the accommodation portion 14 has a groove for accommodating the second elastic element 32 (not shown) so that the second elastic element 32 is limited in the groove when the second elastic element 32 is deformed by the external pushing force.

Figure 6:
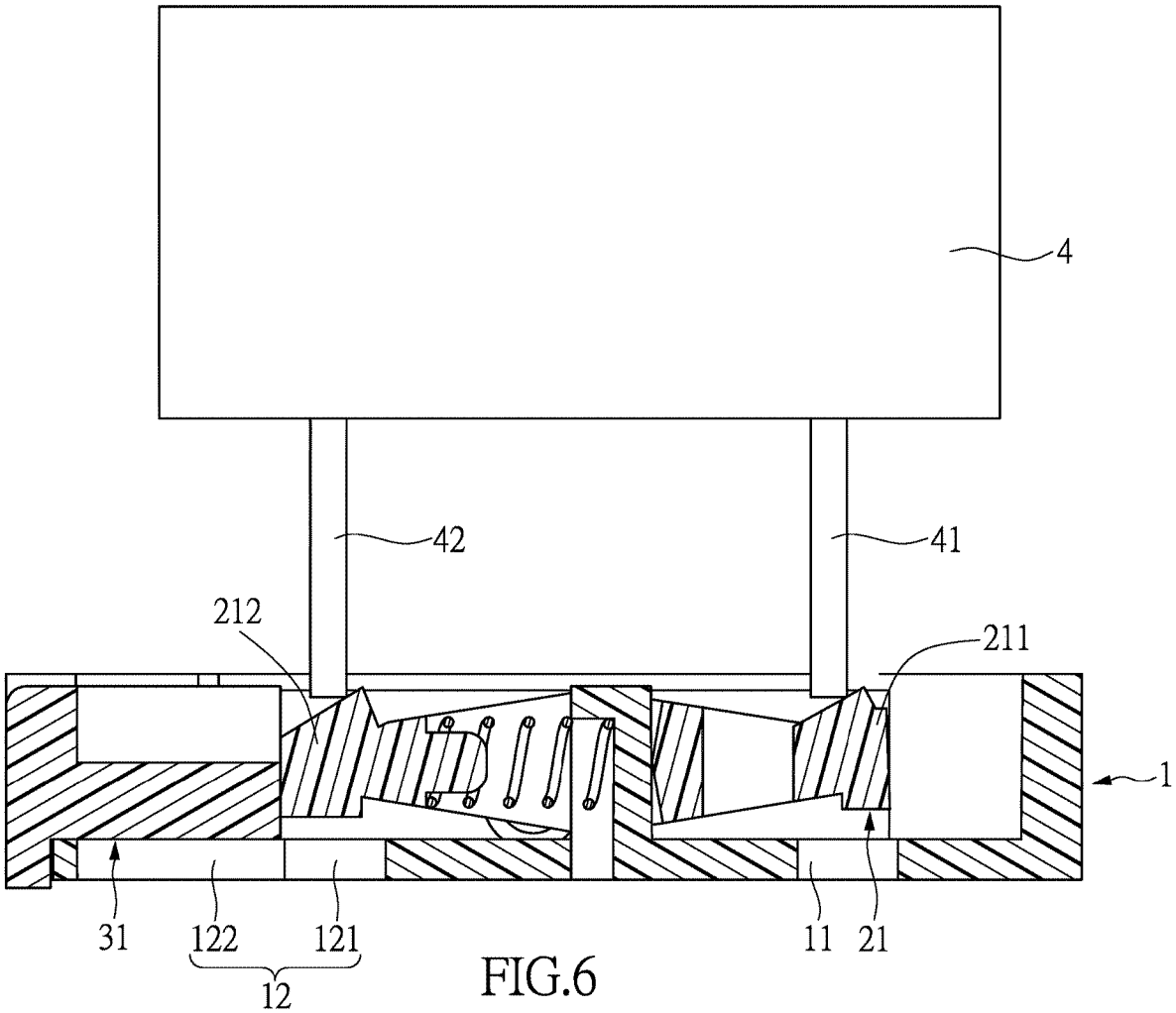
FIG. 6 shows a cross-sectional schematic view of a first plug contacting the first movable assembly according to the instant disclosure.

Please refer to FIG. 5 and FIG. 6. FIG. 6 shows a cross-sectional view of a first plug contacting the first movable assembly according to the instant disclosure. In this embodiment, a first plug 4 has two parallel blades 41, 42. One of the two blades 41 contacts to one of the two first guide portions 211, and the other blade 42 contacts to the other first guide portion 212. At this time, the first plug hole 11 on the carrier 1 is shielded by the first movable assembly, the first portion 121 of the second plug hole 12 is shielded by the first movable assembly, and second portion 122 of the second plug hole 12 is shielded by the second movable assembly.

Figure 7:
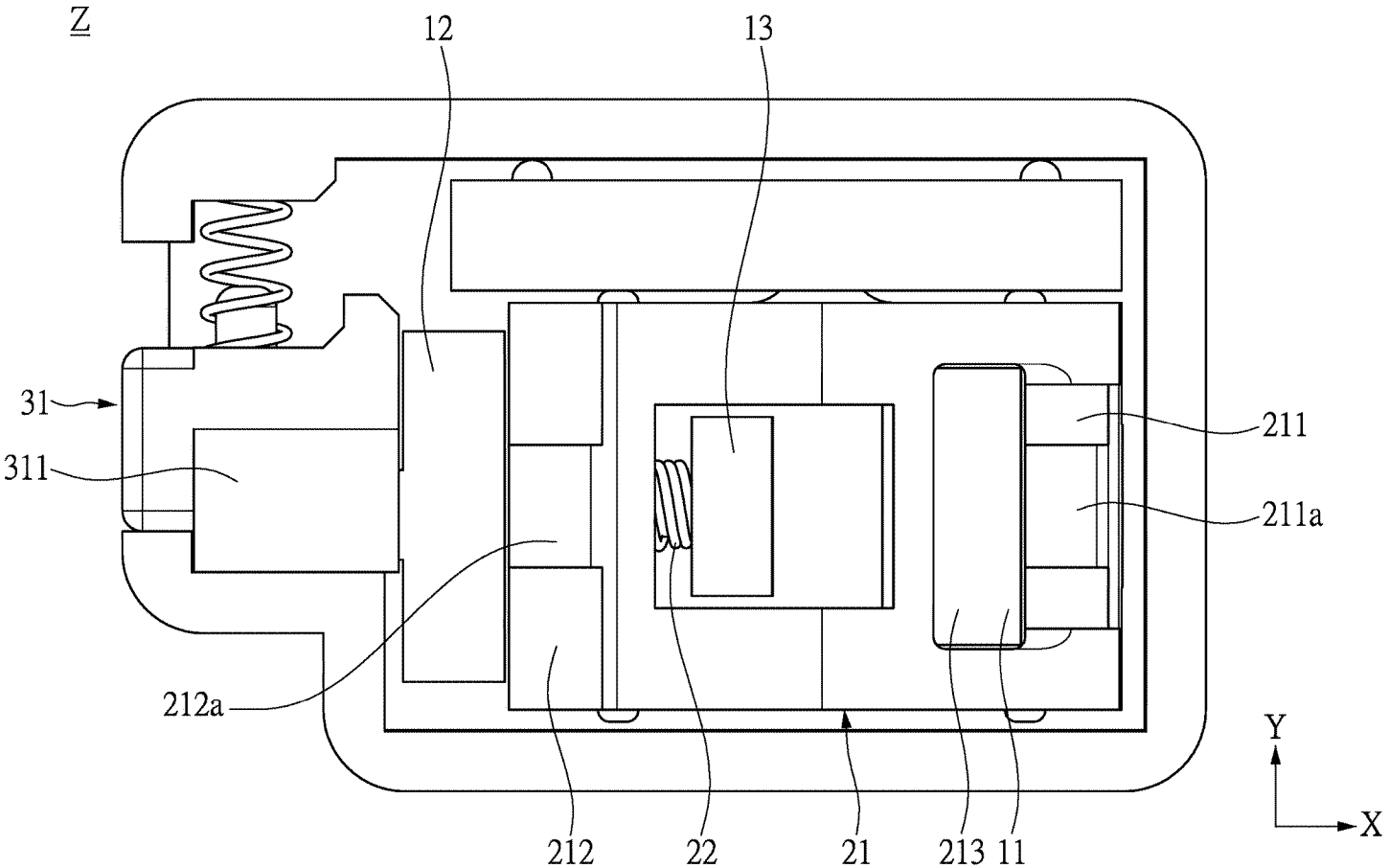
FIG. 7 shows a top perspective schematic view of the first movable assembly moved by the first plug according to the instant disclosure.
Figure 8:
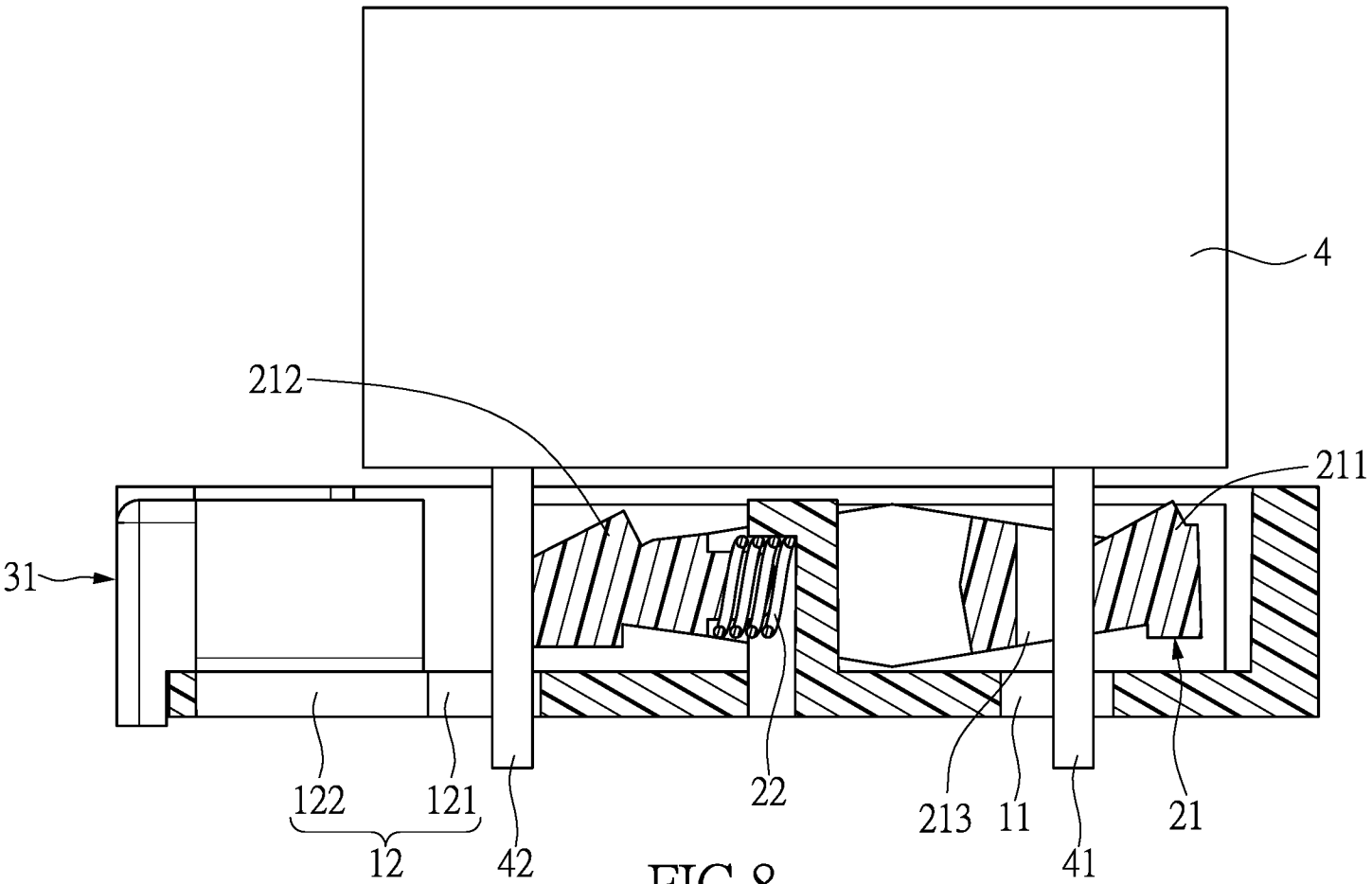
FIG. 8 shows a cross-sectional schematic view of the first plug passing through the first plug hole and the first portion of a second plug hole according to the instant disclosure.

Next, please refer to FIG. 7 and FIG. 8. FIG. 7 shows a top perspective view of the first movable assembly moved by the first plug according to the instant disclosure. FIG. 8 shows a cross-sectional view of the first plug passing through the first plug hole and the first portion of a second plug hole according to the instant disclosure. FIG. 7 shows the top perspective view of the safety socket device Z moved by the blades of the plug (as shown in FIG. 8). When the two first guide portions 211, 212 are respectively pushed by two blades 41, 42 of a first plug 4 for moving the first moving element 21, the first plug hole 11 and the first portion 121 of the second plug hole 12 are exposed from the first moving element 21, so that the two blades 41, 42 of the first plug 4 respectively pass through the first plug hole 11 and the first portion 121 of the second plug hole 12.

The blades 41, 42 move the first moving element 21 by the external pushing force when one of the two blades 41 contacts one of the two first guide protrusions 211*a* and the other blade 42 contacts the other first guide protrusion 212*a*. The first elastic element 22 is abutted against the fixed column 13 by movement of the first moving element 21, and the first moving element 21 moves away from the second movable assembly 3 (X axis). Next, one of the two blades 41 is allowed to pass through the opening 213 of the first moving element 21 and the first plug hole 11 and the other blade 42 contacting the first guide protrusion 212*a* is allowed to pass through the first portion 121 of the second plug hole 12 by movement of the first moving element 21.

Figure 9:
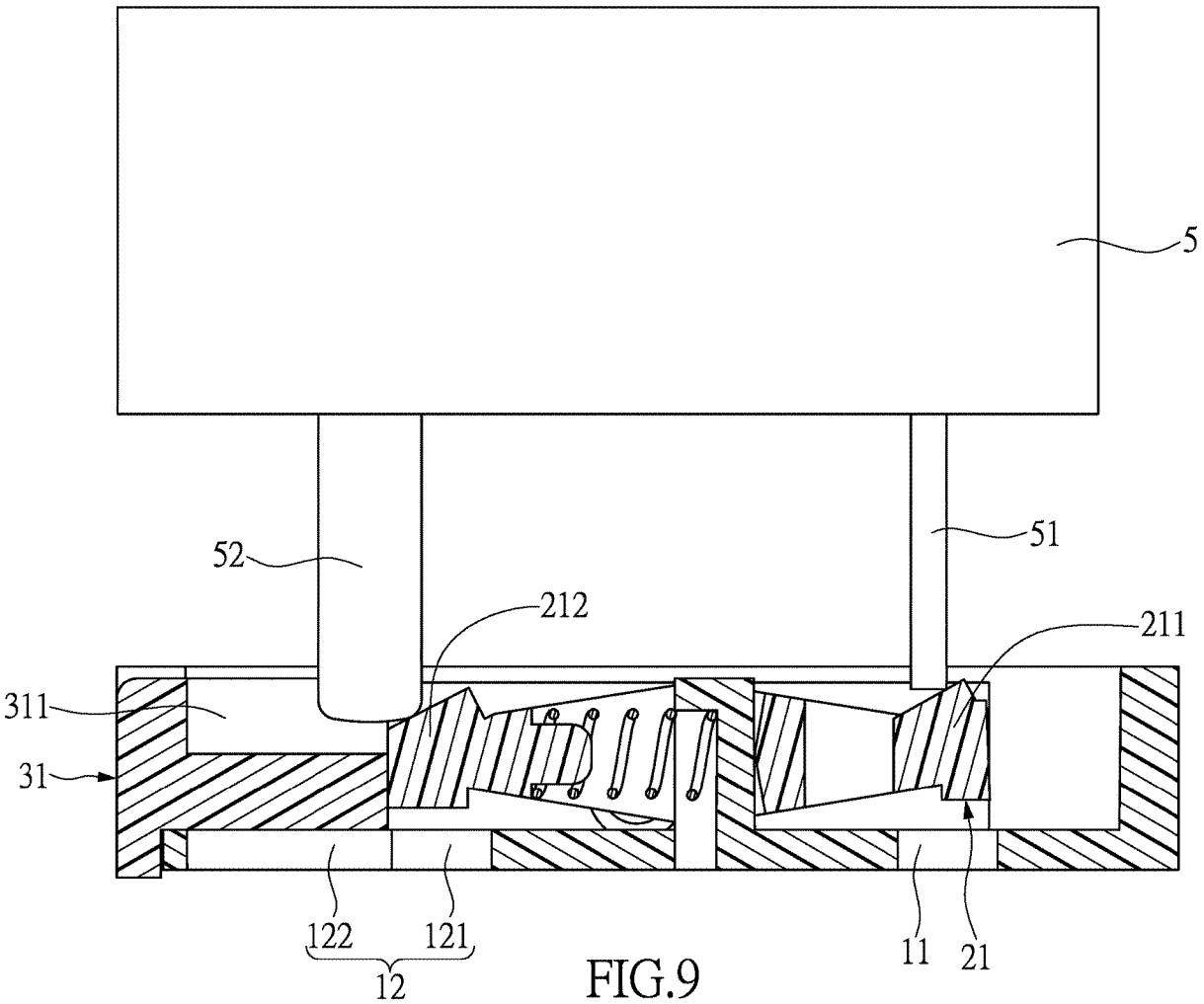
FIG. 9 shows a cross-sectional schematic view of the second plug contacting the first movable assembly and the second movable assembly according to the instant disclosure.

Please refer to FIG. 5 and FIG. 9. FIG. 9 shows a cross-sectional view of the second plug contacting the first movable assembly and the second movable assembly according to the instant disclosure. In this embodiment, a second plug 5 has two perpendicular blades 51, 52. One of the two blades 51 contacts to one of the two first guide portions 211, and the other blade 52 contacts to the second guide portion 311 and the other first guide portion 212. At this time, the first plug hole 11 on the carrier 1 is shielded by the first movable assembly, the first portion 121 of the second plug hole 12 is shielded by the first movable assembly, and the second portion 122 of the second plug hole 12 is shielded by the second movable assembly.

Figure 10:
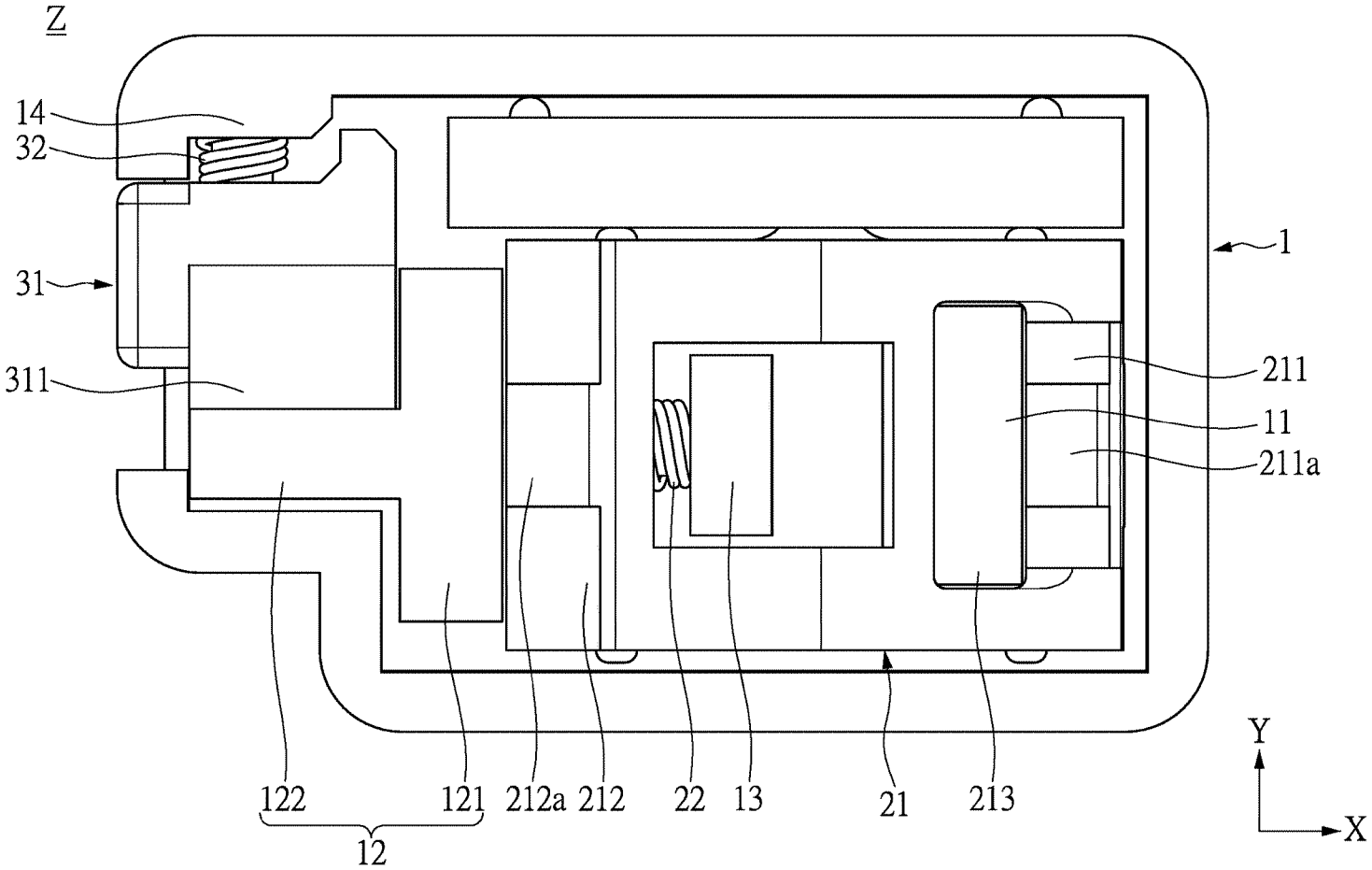
FIG. 10 shows a top perspective schematic view of the first movable assembly and the second movable assembly moved by a second plug according to the instant disclosure.
Figure 11:
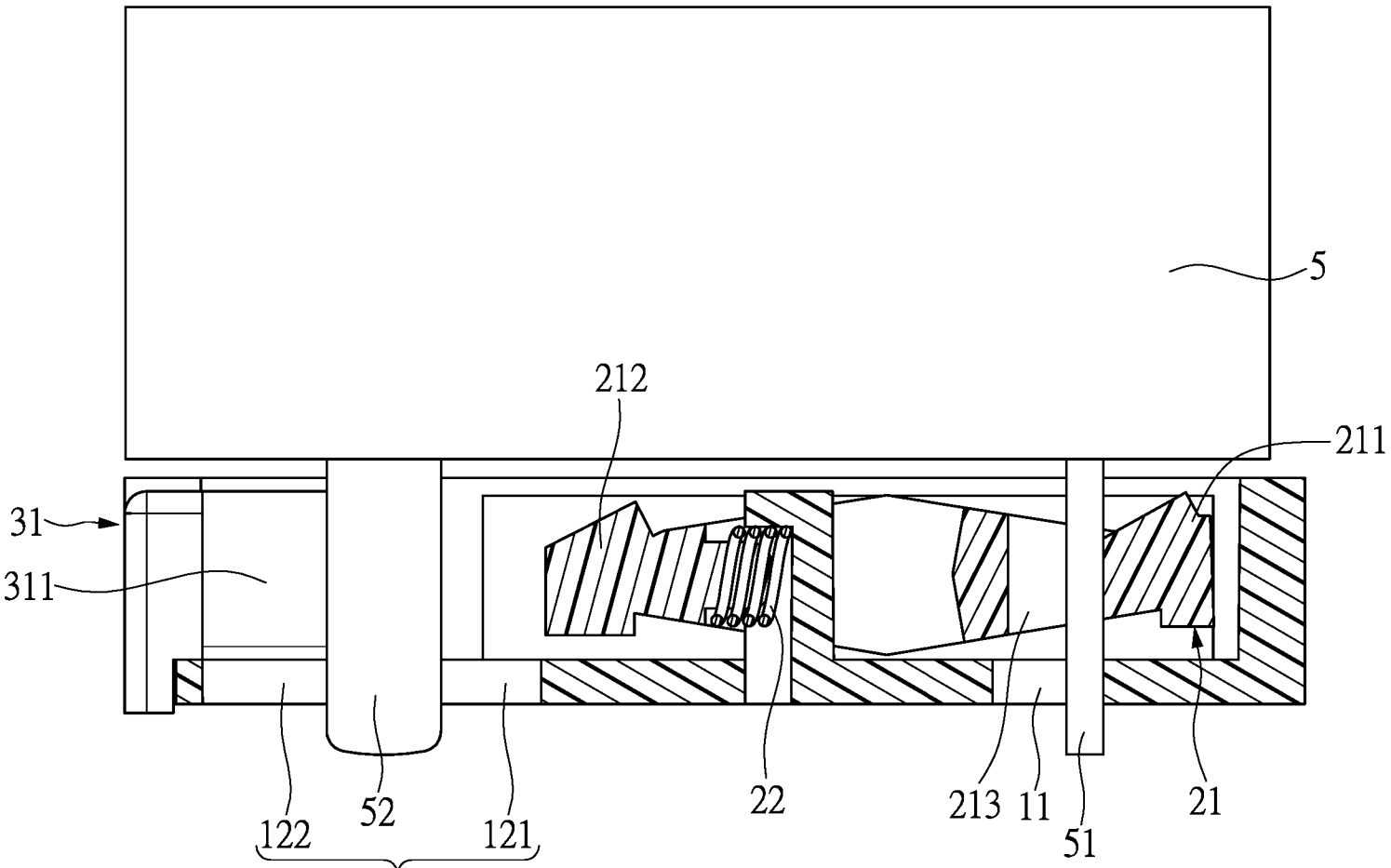
FIG. 11 shows a cross-sectional schematic view of the second plug passing through the first plug hole and the second portion of the second plug hole according to the instant disclosure.

Next, please refer to FIG. 10 and FIG. 11. FIG. 10 shows a top perspective view of the first movable assembly and the second movable assembly moved by the second plug according to the instant disclosure. FIG. 11 shows a cross-sectional view of the second plug passing through the first plug hole and the second portion of the second plug hole according to the instant disclosure. FIG. 10 showing the top perspective view of the safety socket device Z moved by the blades of the plug (as shown in FIG. 11). When one of the two first guide portions 211, 212 and the second guide portion 311 are respectively pushed by two blades 51, 52 of a second plug 5 for respectively moving the first moving element 21 and the second moving element 31, the first plug hole 11 is exposed from the first moving element 21, the first portion 121 of the second plug hole 12 is exposed from the first moving element 21, and the second portion 122 of the second plug hole 12 is exposed from the second moving element 31. Therefore, the two blades 51, 52 of the second plug 5 respectively pass through the first plug hole 11 and the second portion 122 of the second plug hole 12.

To be specific, one of the two blades 51 moves the first moving element 21 by the external pushing force when one of the two blades 51 contacts one of the two first guide protrusions 211*a* and the other blade 52 contacts the second guide portion 311 and the other first guide protrusion 212*a*. The first elastic element 22 is abutted against the fixed column 13 by movement of the first moving element 21, and the first moving element 21 moves away from the second movable assembly 3 (X axis). At the same time, the other blade 52 moves the first moving element 21 and the second moving element 31. The other blade 52 for assisting the first moving element 21 moves away from the second movable assembly 3 (X axis), and the second moving element 31 pushes toward perpendicular direction from the first moving element 21 (Y axis), so that the second elastic element 32 abuts against the accommodation portion 14. One of the two blades 51 is allowed to pass through the opening 213 of the first moving element 21 and the first plug hole 11 and the other blade 52 is allowed to pass through the second portion 122 of the second plug hole 12 from the first guide protrusion 212*a* and the second guide portion 311 by movement of the first moving element 21.

FIG. 5 to FIG. 8 and embodiments described above disclose a normal state of the blades of the first plug 4 passing through the safety socket device Z. FIG. 5, FIG. 9 to FIG. 11 and embodiments described above disclose a normal state of the blades of the second plug 5 passing through the safety socket device Z. However, FIG. 12 to FIG. 14 will introduce an abnormal state of a foreign body inserting into the safety socket device Z.

Figure 12:
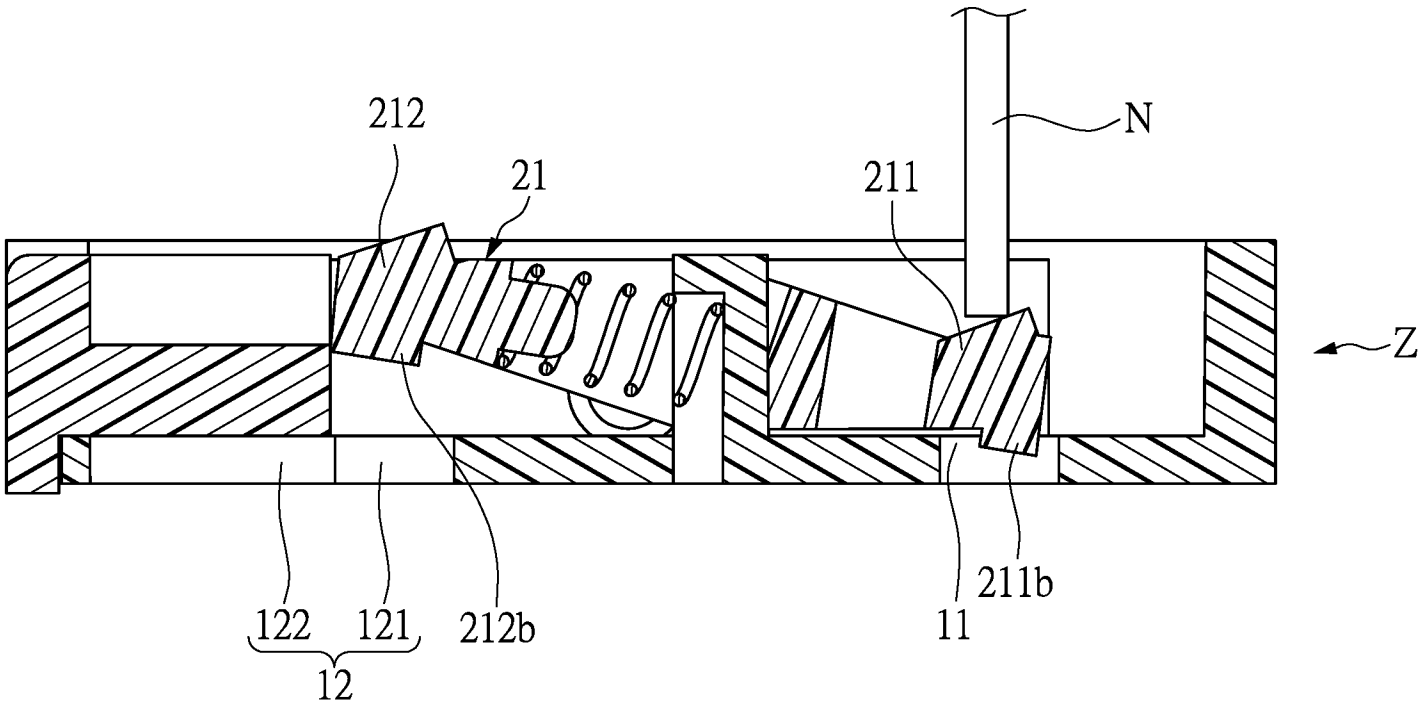
FIG. 12 is a cross-sectional schematic view of a foreign body contacting one of the two first guide portions according to the instant disclosure.
Figure 13:
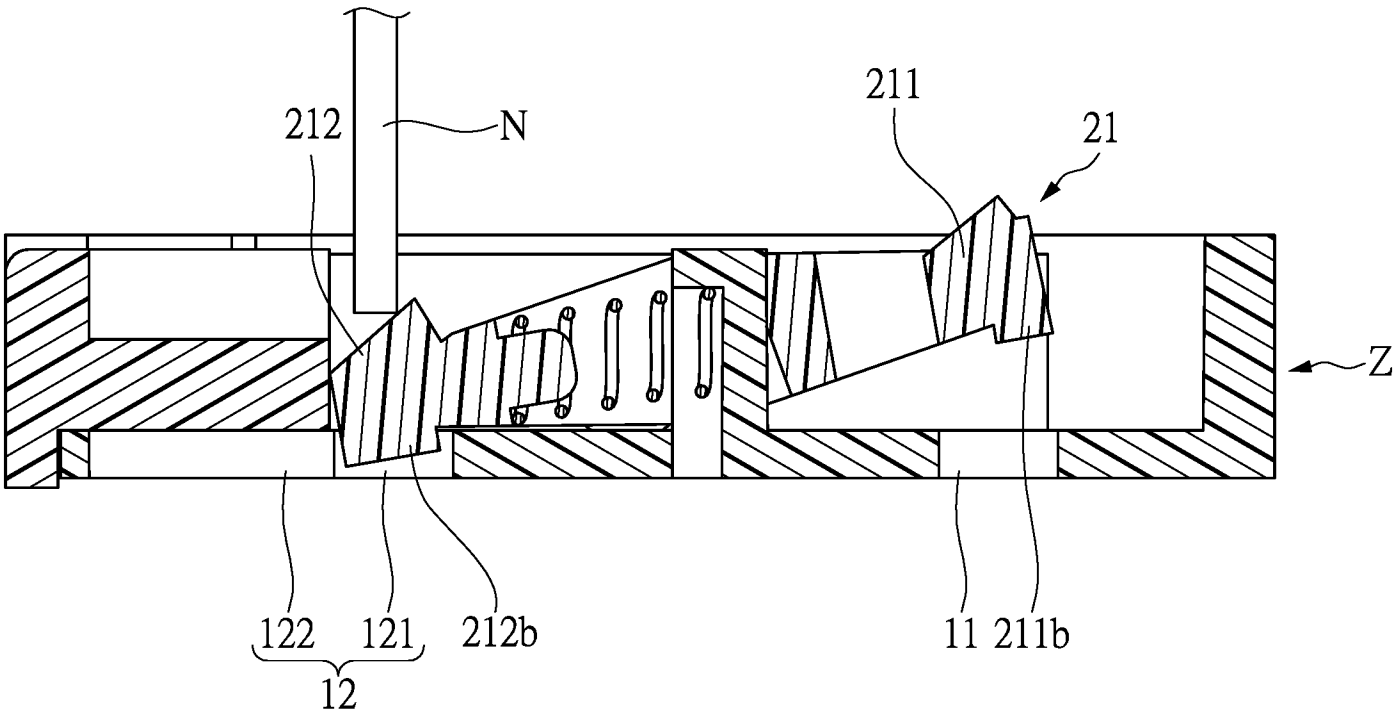
FIG. 13 is a cross-sectional schematic view of the foreign body contacting the other first guide portion according to the instant disclosure.

For when a foreign body N inserts into the safety socket device Z, please refer to FIG. 12 and FIG. 13. FIG. 12 is a cross-sectional view of a foreign body contacting one of the two first guide portions according to the instant disclosure. FIG. 13 is a cross-sectional view of the foreign body contacting the other first guide portion according to the instant disclosure. The first moving element 21 is a three dimensional rhombic-like structure, and a braking portion 211*b* is disposed relatively below one of the two first guide portions 211, the other braking portion 212*b* is disposed relatively below the other first guide portion 212. Therefore, when the foreign body N only contacts one of the two first guide portions 211 (as shown in FIG. 12), the braking portion 211*b* is engaged to the first plug hole 11 by an external force from the foreign body N pushing the first moving element 21, so as to prevent the foreign body N passing through the first plug hole 11. Similarly, when a foreign body N only contacts the other first guide portion 212 (as shown in FIG. 13), the braking portion 212*b* is engaged to the first portion 121 of the second plug hole 12 by an external force from the foreign body N pushing the first moving element 21, so as to prevent the foreign body N passing through the second plug hole 12.

Figure 14:
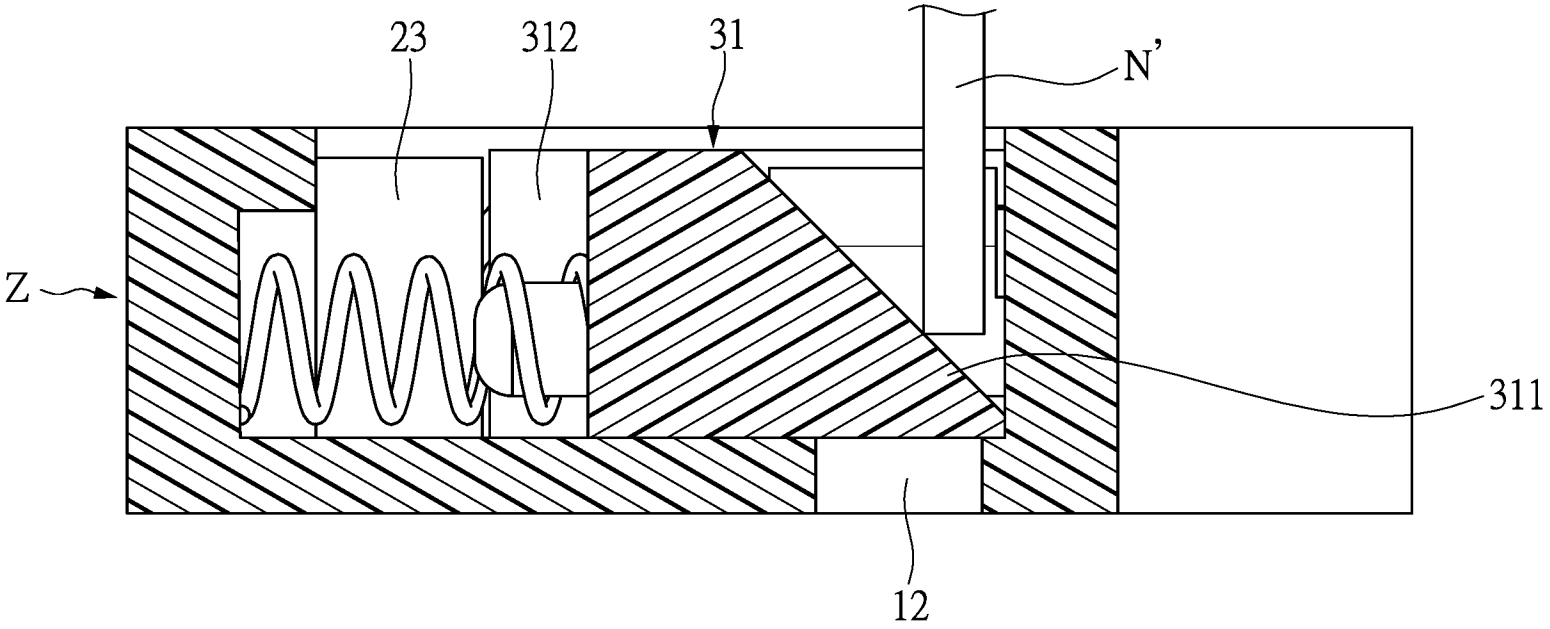
FIG. 14 is a cross-sectional schematic view of the foreign body contacting one of the two first guide portions and the second guide portion according to the instant disclosure.

For when a foreign body N' is inserted into the safety socket device Z, please refer to FIG. 14. FIG. 14 is a cross-sectional view of the foreign body contacting one of the two first guide portions and the second guide portion according to the instant disclosure. When the foreign body N' contacts the first guide portion and the second guide portion 311 and the foreign body N' applies an external force thereon, the stopping portion 312 of the second moving element 31 is stopped by the connecting element 23 and cannot be moved, so that the second plug hole 12 cannot be exposed, preventing the foreign body N' passing through the second plug hole 12.

In sum, the advantages of the instant disclosure provide a safety socket device, when a foreign body inserts into the socket, the first plug hole and the second plug hole are still shielded by the first movable assembly and the second movable assembly for effectively preventing the inserting foreign body.

Another advantage of the instant disclosure is that it provides the stopping portion for limiting movement of the connecting element so that the second moving element still shields a portion of the second plug hole for preventing the foreign body inserting, as a safety socket device.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A safety socket device, comprising:

a carrier having a first plug hole and a second plug hole;

a first movable assembly including a first moving element transversely movably disposed in the carrier, and a connecting element, wherein the first moving element has two first guide portions and a connecting column, and the two first guide portions are moved for exposing the first plug hole from the first moving element by an external pushing force, and the connecting element has a connecting hole thereon, wherein the connecting hole is mated with the connecting column disposed on the first moving element, and the first moving element is moved to move the connecting element by the connecting column; and a second movable assembly including a second moving element longitudinally movably disposed in the carrier, wherein the second moving element has a second guide portion, and the second guide portion is moved for exposing the second plug hole from the second moving element by the external pushing force;

wherein the second moving element further includes a stopping portion having a chamfer, and the stopping portion is abutted against the connecting element for limiting movement of the second moving element.

2. The safety socket device according to claim 1, wherein a movement direction of the first moving element is perpendicular to a movement direction of the second moving element.

3. The safety socket device according to claim 1, wherein the first plug hole is perpendicular to the second plug hole.

4. The safety socket device according to claim 1, wherein the second plug hole has a first portion parallel to the first plug hole and a second portion communicated with the first portion and perpendicular to the first plug hole.

5. The safety socket device according to claim 4, wherein when the two first guide portions are respectively pushed by two parallel blades of a first plug for moving the first moving element, the first plug hole and the first portion of the second plug hole are exposed from the first moving element, so that the two blades of the first plug respectively pass through the first plug hole and the first portion of the second plug hole.

6. The safety socket device according to claim 4, wherein when one of the two first guide portions and the second guide portion are respectively pushed by two perpendicular blades of a second plug for respectively moving the first moving element and the second moving element, the first plug hole and the second portion of the second plug hole are respectively exposed from the first moving element and the second moving element, so that the two blades of the second plug respectively pass through the first plug hole and the second portion of the second plug hole.

7. The safety socket device according to claim 1, wherein the first movable assembly further includes a first elastic element, the first elastic element is connected between the first moving element and the carrier.

8. The safety socket device according to claim 7, wherein the first moving element further includes a restriction opening and a first convex column is protruded from an inner wall of the restriction opening, one end portion of the first elastic element is disposed around the first convex column and another end portion of the first elastic element is abutted against a fixed column of the carrier.

9. The safety socket device according to claim 7, wherein the second movable assembly further includes a second elastic element, the second elastic element is connected between the second moving element and the carrier.

10. The safety socket device according to claim 9, wherein the second moving element has a second convex column, and one end portion of the second elastic element is disposed around the second convex column and another end portion of the second elastic element is disposed on an accommodation portion of the carrier.

11. The safety socket device according to claim 9, wherein the first elastic element is disposed perpendicular to the second elastic element.

12. The safety socket device according to claim 1, wherein each first guide portion of the first moving element is a guiding inclined surface, and the second guide portion of the second moving element is a guiding inclined surface.

13. A safety socket device, comprising:

a carrier having a first plug hole and a second plug hole;

a first movable assembly including:

a first moving element transversely movably disposed in the carrier; and a first elastic element, the first elastic element is connected between the first moving element and the carrier;

a connecting element;

wherein the first moving element has two first guide portions and a connecting column, and the two first guide portions are moved for exposing the first plug hole from the first moving element by an external pushing force, and the connecting element has a connecting hole thereon, wherein the connecting hole is mated with the connecting column disposed on the first moving element, and the first moving element is moved to move the connecting element by the connecting column; and wherein the first moving element further includes a restriction opening and a first convex column is protruded from an inner wall of the restriction opening, one end portion of the first elastic element is disposed around the first convex column and another end portion of the first elastic element is abutted against a fixed column of the carrier;

a second movable assembly including a second moving element and a second elastic element, the second moving element longitudinally movably disposed in the carrier, wherein the second moving element has a second guide portion, and the second guide portion is moved for exposing the second plug hole from the second moving element by the external pushing force, wherein the second elastic element is connected between the second moving element and the carrier;

wherein the fixed column has a groove for accommodating the first elastic element so that the first elastic element is limited in the groove when the first elastic element is deformed by the external pushing force;

wherein the second moving element further includes a stopping portion having a chamfer, and the stopping portion is abutted against the connecting element for limiting movement of the second moving element.

* * * * *